US009967923B2

(12) United States Patent
Moon et al.

(10) Patent No.: US 9,967,923 B2
(45) Date of Patent: May 8, 2018

(54) COOKER, POWER CONTROL METHOD OF THE COOKER, AND POWER CONTROL SYSTEM HAVING THE SAME

(71) Applicant: LG Electronics Inc., Seoul (KR)

(72) Inventors: Hyunwook Moon, Seoul (KR); Byeongwook Park, Seoul (KR); Yangkyeong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1101 days.

(21) Appl. No.: 14/235,360

(22) PCT Filed: Oct. 24, 2012

(86) PCT No.: PCT/KR2012/008745
§ 371 (c)(1),
(2) Date: Jan. 27, 2014

(87) PCT Pub. No.: WO2013/062299
PCT Pub. Date: May 2, 2013

(65) Prior Publication Data

US 2014/0158679 A1 Jun. 12, 2014

(30) Foreign Application Priority Data

Oct. 24, 2011 (KR) ..... 10-2011-0108983

(51) Int. Cl.

| | |
|---|---|
| ***H05B 6/06*** | (2006.01) |
| ***H05B 6/08*** | (2006.01) |
| ***H05B 6/12*** | (2006.01) |
| ***H05B 1/02*** | (2006.01) |

(52) U.S. Cl.
CPC ..... *H05B 6/065* (2013.01); *H05B 1/0266* (2013.01); *H05B 6/062* (2013.01); *H05B 6/1209* (2013.01)

(58) Field of Classification Search
CPC ..... H05B 1/0266; H05B 6/062; H05B 6/065; H05B 6/1209
USPC ..... 219/620, 624, 625, 626, 632, 660, 661, 219/662, 663, 664, 665; 126/21 A, 126/299 R, 299 D; 99/337
See application file for complete search history.

(56) References Cited

U.S. PATENT DOCUMENTS

| | | | | |
|---|---|---|---|---|
| 5,010,223 A * | 4/1991 | Kim | H05B 6/06 219/626 |
| 5,700,996 A * | 12/1997 | Lee | H05B 6/062 219/626 |
| 2010/0312414 A1* | 12/2010 | Kumar | H02J 3/14 700/295 |

FOREIGN PATENT DOCUMENTS

| | | | |
|---|---|---|---|
| JP | 2008027638 | A | 2/2008 |
| JP | 2010262883 | A | 11/2010 |
| KR | 1019900007383 | B1 | 10/1990 |
| KR | 100253548 | B1 | 4/2000 |

(Continued)

*Primary Examiner* — Quang Van
(74) *Attorney, Agent, or Firm* — Dentons US LLP

(57) ABSTRACT

A cooker, a method for controlling power of a cooker, and a power control system including the same are provided. A high power cooking device can be used without making an additional power construction work or causing a power circuit breaker installed in an input terminal of a household power source to be opened. Driving power of a burner is controlled or distributed by using a current flowing in a power circuit breaker or an overcurrent breaker installed in a load end, whereby power operation efficiency of an input power source can be enhanced and the input power source cannot be broken.

18 Claims, 6 Drawing Sheets

(56) References Cited

FOREIGN PATENT DOCUMENTS

| | | | |
|---|---|---|---|
| KR | 100904235 | B1 | 6/2009 |
| KR | 1020110018209 | A | 2/2011 |

* cited by examiner

[Fig. 1]
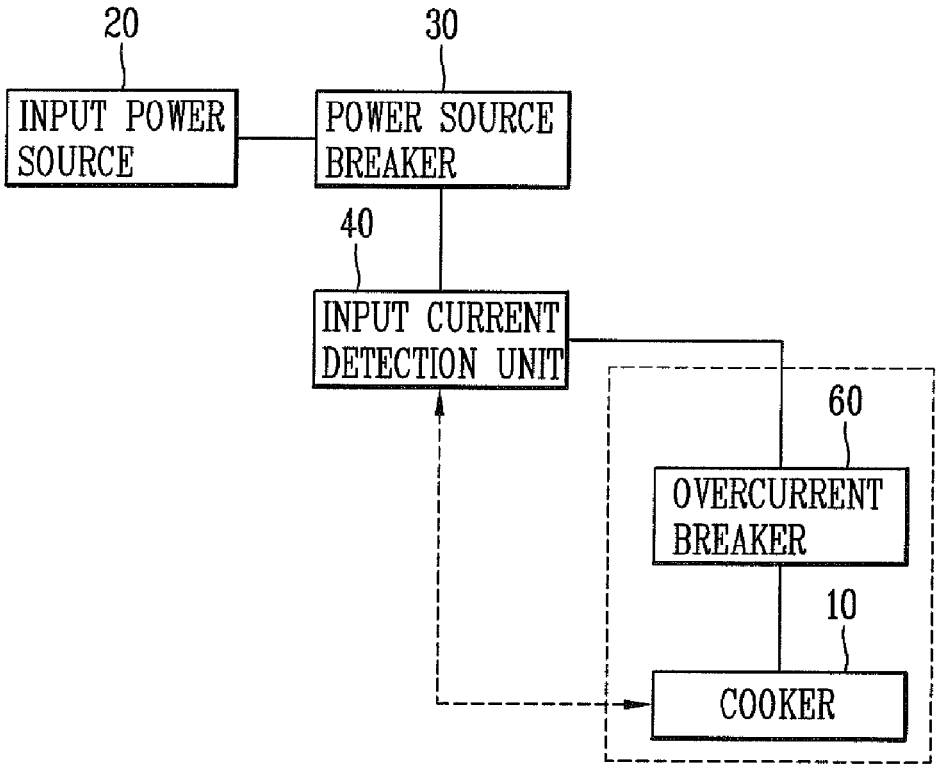
[Fig. 2]
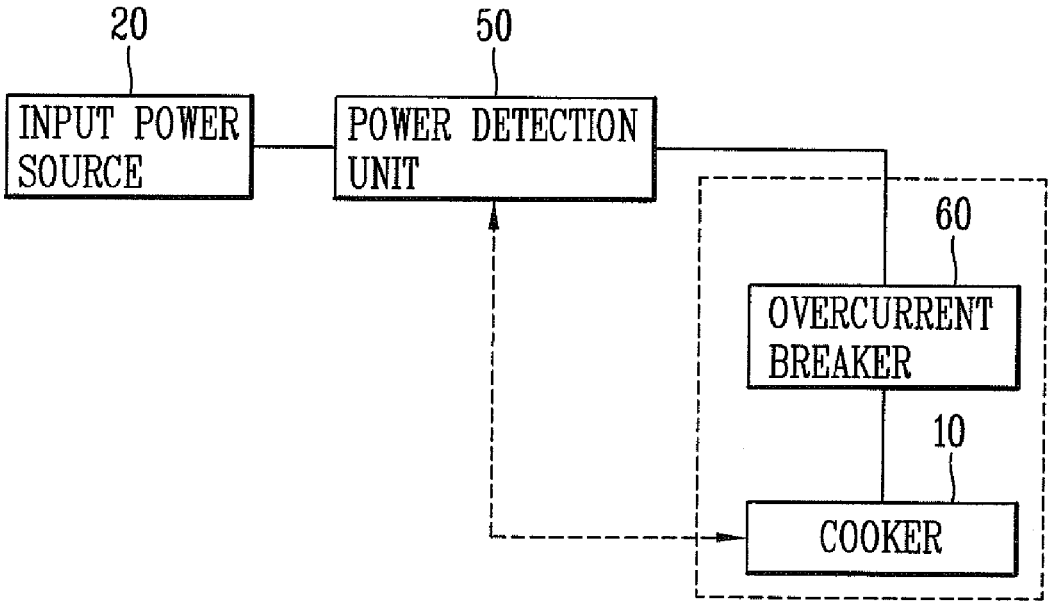

[Fig. 3]
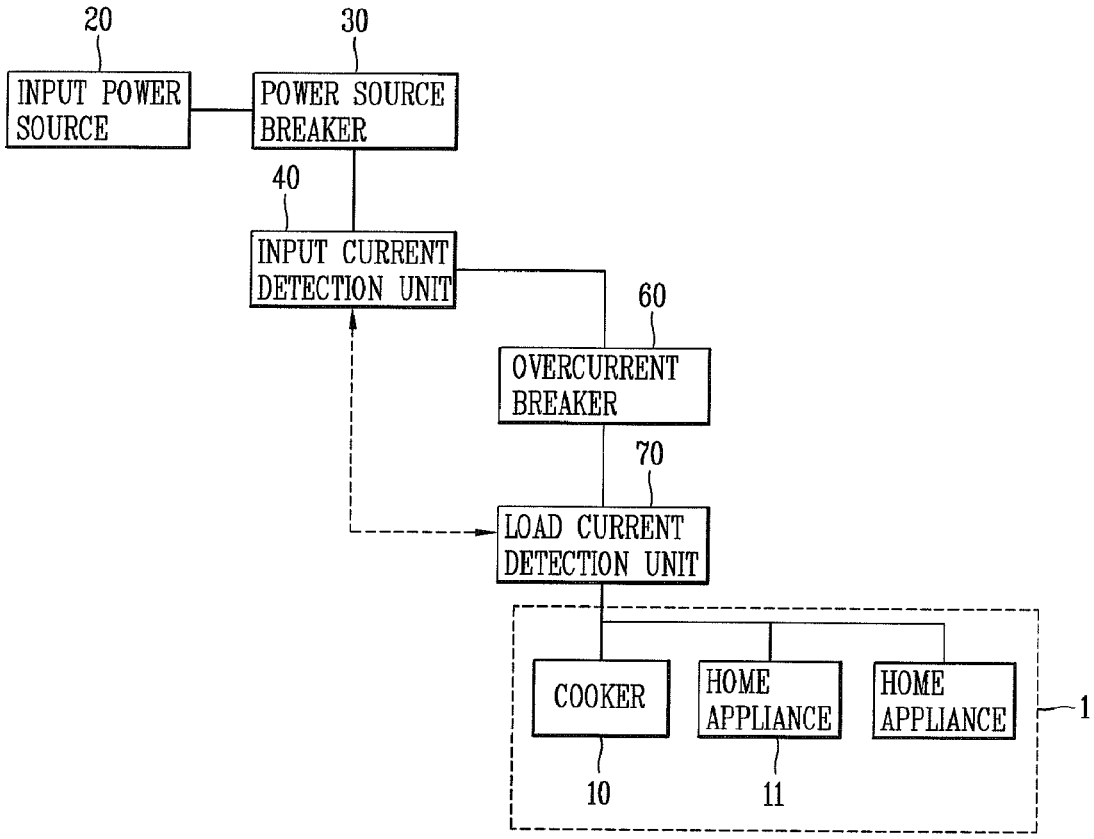
[Fig. 4]
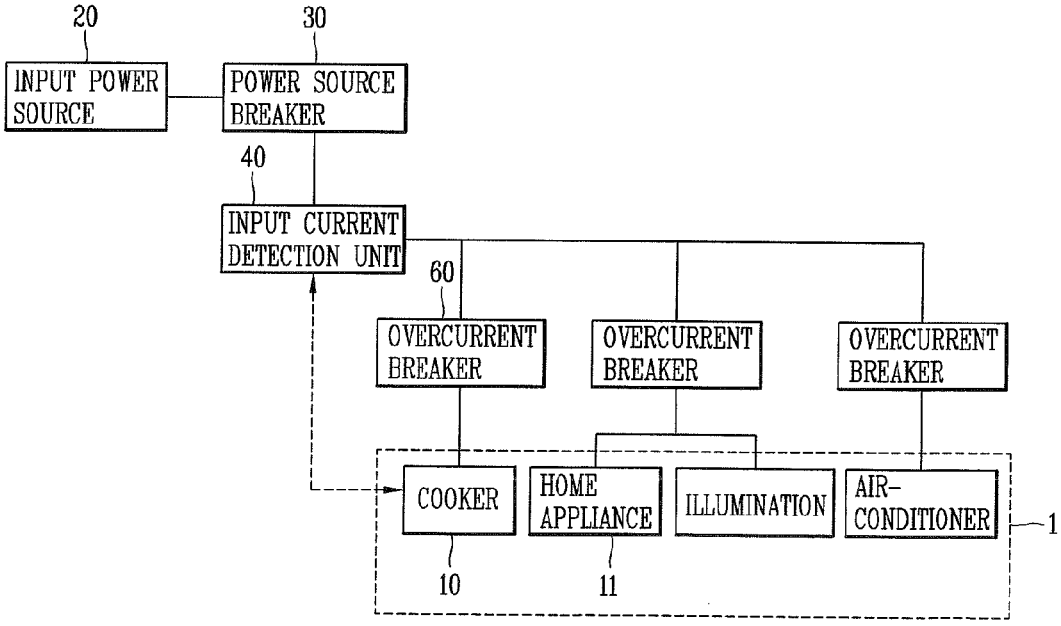

[Fig. 5]
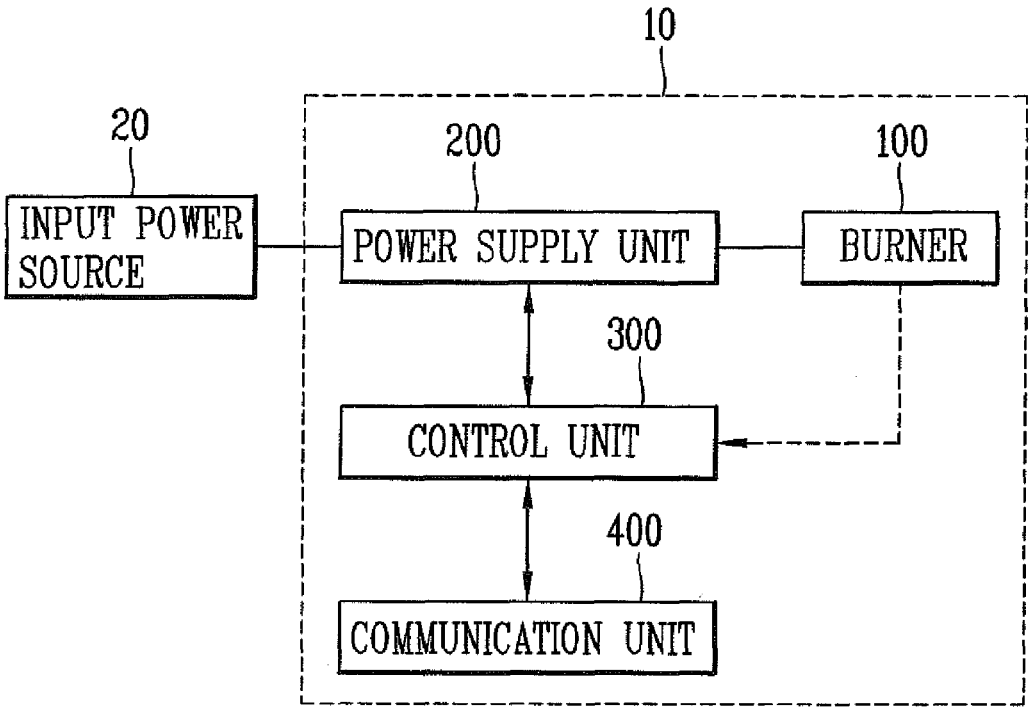
[Fig. 6]
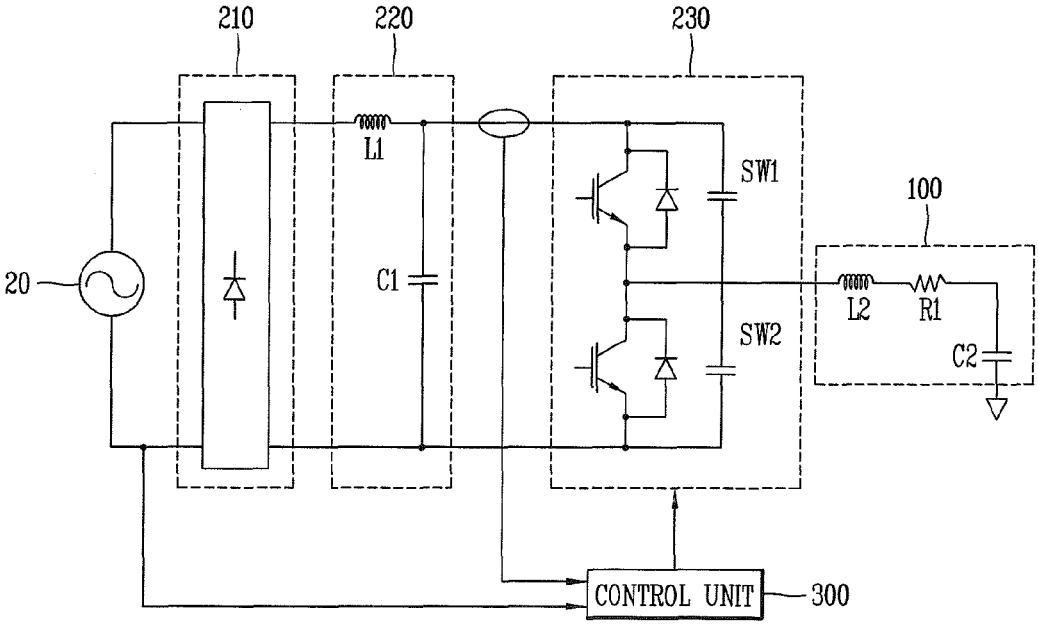

[Fig. 7]
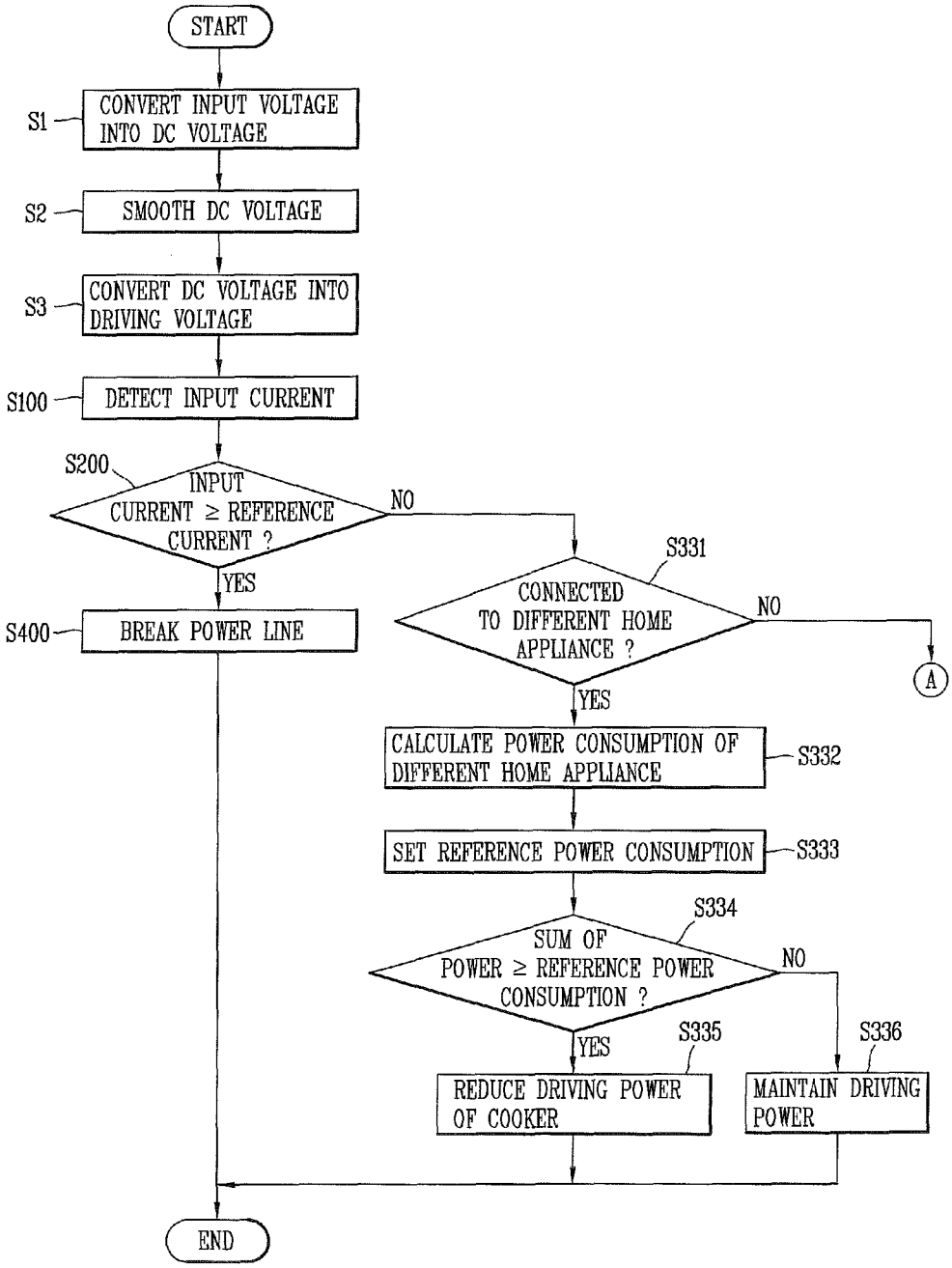

[Fig. 8]
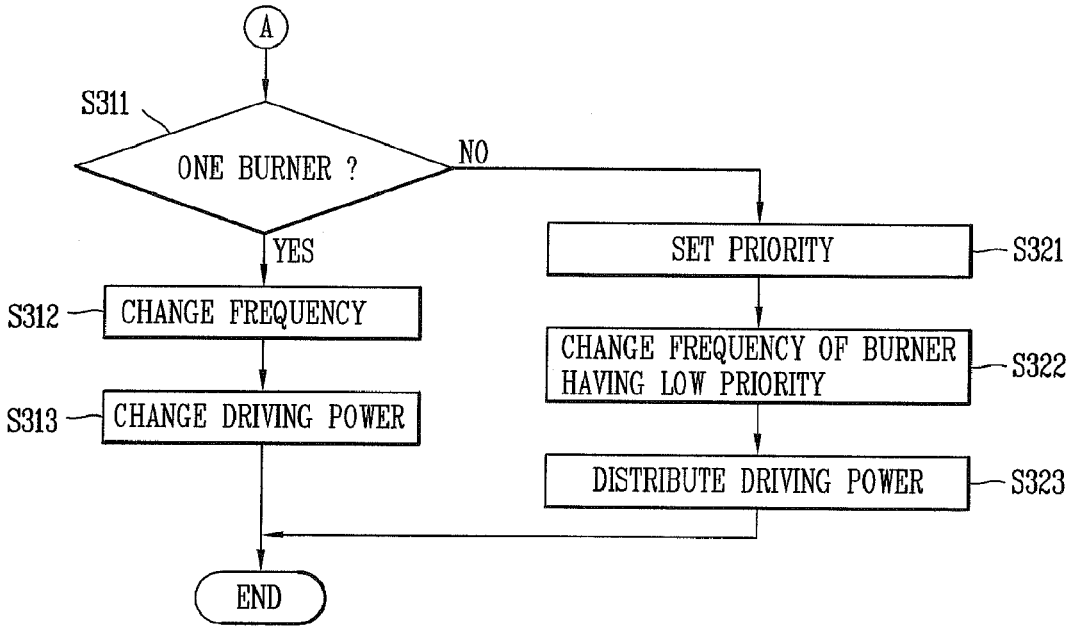
[Fig. 9]
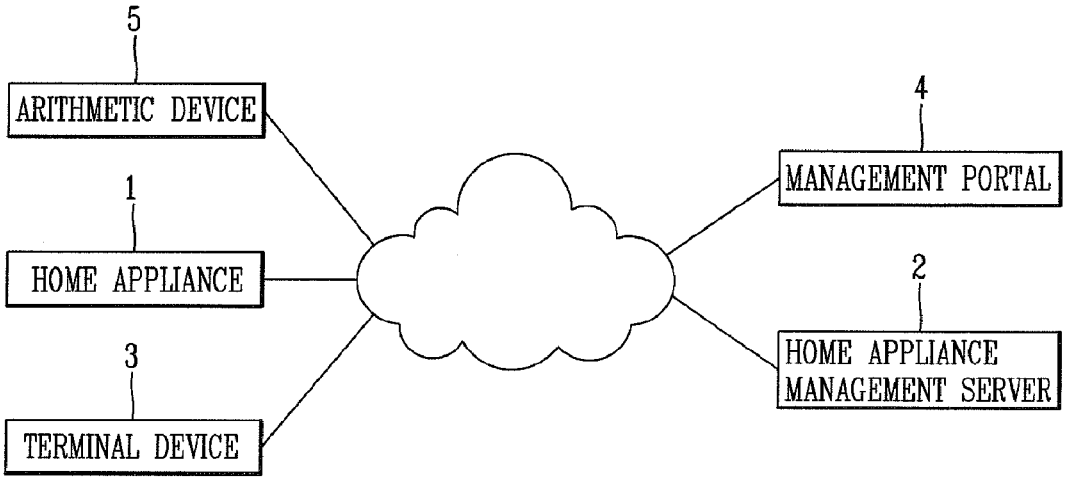

[Fig. 10]
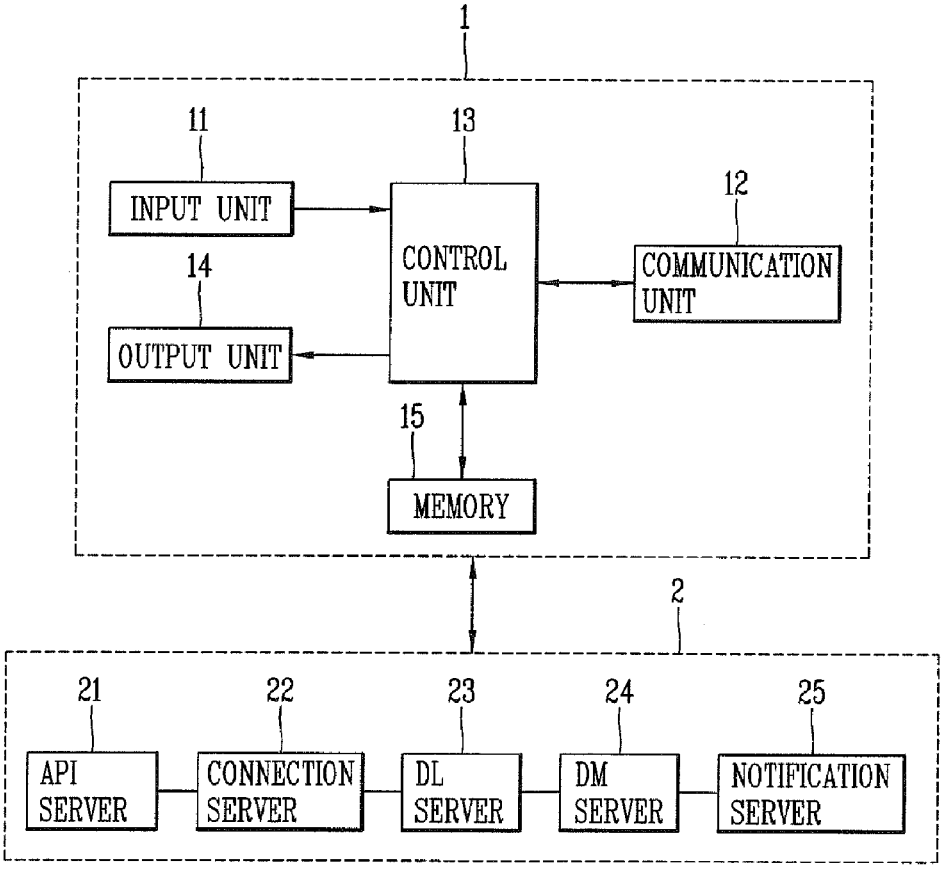
[Fig. 11]
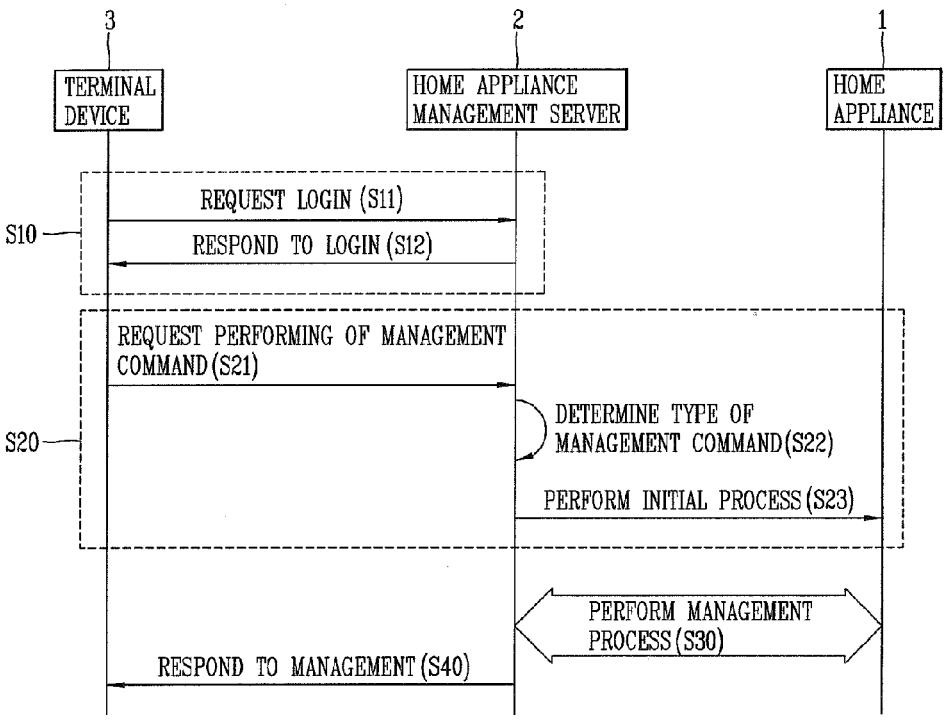

COOKER, POWER CONTROL METHOD OF THE COOKER, AND POWER CONTROL SYSTEM HAVING THE SAME

This application is a national stage application of International Application No. PCT/KR2012/008745, filed on Oct. 24, 2012, which claims priority to and the benefit of Korean Patent Application No. 10-2011-0108983, filed Oct. 24, 2011, in the Korean Intellectual Property Office, the entire content of which are incorporated by reference in their entirety as if fully set forth herein.

BACKGROUND ART

A cooker is one of home appliances for cooking food in a container by heating the container by using a heat source. According to types of heat source, cookers may be divided into a gas range and a gas oven using a gas, an electronic range using power, an electric oven, an induction heating cooker, and the like. The electronic range or the electric oven is a cooker cooking food by using microwaves, in which microwaves generated from a magnetron are irradiated to the interior of a cooking chamber through a waveguide to vibrate water molecules contained in food to generate heat energy to thus cook food.

An induction heating cooker, one of cookers, is a device for cooking food by using heat generated by an eddy current loss and a hysteresis loss made in a cooking container made of a metal material by applying an AC magnetic field to the container, having an advantage of attaining high efficiency.

When the induction heating cooker and high power cooking devices exceed an allowable current value of a distributing board, a circuit breaker is open to interrupt power in home, and this situation may frequently occur. Thus, in order to user a high power cooker, users have a burden of increasing the capacity of an incoming line (or a service line) and an allowable capacity of the distributing board circuit breaker through a construction work of extending supply power incoming to home. However, a circuit breaker may be open even after the extension work.

Electronic products disposed in the interior of a house (referred to as home appliances, hereinafter), e.g., a refrigerator, a washing machine, an air-conditioner, a home appliance, and the like, provide convenience to user by performing characteristic function thereof. Recently, home appliances within a house are connected via a network, forming a so-called home network, and a user may remotely control home appliances within a house. Thus, even when a user is absent, the user may turn on or off a home appliance or control a function of a home appliance. However, controlling of home appliances through a home network is limited to intrinsic functions of home appliances.

A device management refers to a technique of providing functions such as customized setting, remote management, updating, and the like, with respect to various electronic devices (here, home appliances). A device management technique may be used for the purpose of initial setting in manufacturing a product or initial setting of a product after its purchase, collective updating with respect to an error or corrections of a product, remote management with respect to a product, and the like.

Meanwhile, techniques stipulated in OMA (Open Mobile Alliance) have been used as standard techniques in application programs of a mobile communication field and a service field. In order to promote interoperability of mobile data services, OMA deals with mobile Web, Web browsing, DRM solution, IP multimedia, a device management, a mobile broadcast, mobile-related document standardization, and the like. In particular, according to standardization of a technique for a device management in the OMA, processes such as firmware updating, software downloading, a new service, an error correction, and the like, can be wirelessly performed.

DISCLOSURE OF INVENTION

Technical Problem

An aspect of the present invention provides a high power cooker which can be used without making an additional construction work, a method for controlling power of the cooker, and a power control system including the same.

An aspect of the present invention also provides a high power cooker which can be used without causing a power circuit breaker installed in an input terminal of a household electric power to be opened, a method for controlling power of the cooker, and a power control system including the same.

Solution to Problem

According to an aspect of the present invention, there is provided a cooker including:

one or more burners having an induction heating coil and a resonant capacitor and heating a container; a power supply unit converting input power of an input power source into driving power and supplying the driving power to the one or more burners according to a control signal; and a control unit generating a control signal based on input current information regarding an input current of the input power source, and outputting the control signal to the power supply unit to control the driving power with respect to the one or more burners.

According to another aspect of the present invention, there is provided a power control system including: a power circuit breaker installed in a power line of an input power source, and breaking the power line when an input current from the input power source is an overcurrent; an input current detection unit detecting the input current and transmitting input current information by using a wired/wireless communication scheme; and a home appliance driven upon receiving input power from the input power source, wherein the home appliance includes a cooker having one or more burners and controlling driving power with respect to the one or more burners based on the input current information such that the input current cannot be an overcurrent.

According to another aspect of the present invention, there is provided a power control system including: a home appliance driven upon receiving power from an input power source; and a power detection unit connected to the input power source, detecting an input current from the input power source and transmitting input current information to the home appliance, and measuring consumed power of the home appliance, wherein the home appliance includes a cooker having one or more burners and controlling driving power with respect to the one or more burners based on the input current information According to another aspect of the present invention, there is provided a method for controlling power of a cooker including one or more burners having an induction heating coil and a resonant capacitor and heating a container, including: detecting an input current from an input power source; comparing the input current with a predetermined reference current; and when the input current is less than the reference current, controlling driving power with respect to the one or more burners.

According to embodiments of the present invention, a high power cooking device can be used without making an additional power construction work or causing a power circuit breaker installed in an input terminal of a household power source to be opened.

Advantageous Effects of Invention

According to embodiments of the present invention, since driving power of a burner is controlled or distributed by using a current flowing in a power circuit breaker or an overcurrent breaker installed in a load end, power operation efficiency of an input power source can be enhanced and stability of a system can be improved.

According to embodiments of the present invention, since driving power of burners provided in a cooker is appropriately controlled or distributed to prevent an input power source from being interrupted, thus enhancing system stability and user convenience.

BRIEF DESCRIPTION OF DRAWINGS

FIGS. 1 through 4 are block diagrams schematically illustrating a power control system according to embodiments of the present invention;

FIG. 5 is a block diagram schematically illustrating a configuration of a home appliance according to an embodiment of the present invention;

FIG. 6 is a circuit diagram schematically illustrating a configuration of a home appliance according to an embodiment of the present invention;

FIGS. 7 and 8 are flow charts illustrating a method for controlling power of a home appliance according to an embodiment of the present invention;

FIG. 9 is a view schematically illustrating a configuration of a system for managing a home appliance according to an embodiment of the present invention;

FIG. 10 is a block diagram schematically showing a configuration of a home appliance and a home appliance management server; and FIG. 11 is a flow chart illustrating a process of transferring a management command to a home appliance by an external terminal device through a management server and receiving a command performing result.

BEST MODE FOR CARRYING OUT THE INVENTION

Referring to FIG. 9, a system for managing a home appliance according to an embodiment of the present invention includes a home appliance 1 and a home appliance management server 2. Also, the system for managing a home appliance may further include: a terminal device 3, a management portal 4, and an arithmetic device 5.

In the system for managing a home appliance, the home appliance 1 includes a display screen available for inputting and outputting. The home appliance management server 2 is connected to the home appliance 1 and an external terminal device 3 through a communication network, and manages the home appliance 1 according to a management command. Here, the home appliance 1 generates a purchase list according to a designation command with respect to one or more subject goods (or articles or commodities), and displays the purchase list on a display screen. Also, the home appliance 1 may display a connectable purchase site, along with the purchase list, on the display screen, and request purchase of subject goods by using the purchase site.

The home appliance 1 includes a refrigerator, a washing machine, an air-conditioner, a cooker, and the like, as management targets. The home appliance 1 may include hardware, i.e., a household module, performing a household function, and may be a smart home appliance for utilizing a household module in various manners.

The home appliance management server 2 is a device for executing a management service with respect to the home appliance 1. In particular, the management server 2 includes components for requesting performing of a management command from the home appliance 1, receiving performing results of the management command from the home appliance 1, and providing the received performing results to a user.

The management portal 4 is a device for providing a user subscription and support service. The management portal 4 includes a function of managing a home appliance user a function of performing product authentication on a home appliance, and the like. The management portal 4 may be a device, a server, or a service system managed by a manufacturer of the home appliance 1 or a seller of a home appliance.

The arithmetic device 5 is a device used to access a service provided by the management portal. For example, the arithmetic device 5 may be a device having a networking function such as a personal computer, or the like, and a user interface. Also, the arithmetic device 5 may be used to management information regarding the home appliance or information regarding a user.

Meanwhile, the terminal device 3 is a device used to access a management service with respect to the home appliance 1 provided by the home appliance management server 2. The terminal device 3 may use a management service through an application programming interface (API) module provided by the home appliance management server 2. The terminal device 3 may be a certain electronic device that may access the home appliance management server 2 to use a management service with respect to a home appliance including a device management (DM) client. For example, the terminal device 3 may include a portable phone, a cellular phone, a smart phone, a personal digital assistant (PDA), a portable multimedia player (PMP), a tablet device, a computer, a multimedia device, and the like.

Referring to FIG. 10, the home appliance 1 may be configured to include an input unit 11, a communication unit 12, a control unit 13, and an output unit 14. Also, the home appliance 1 may further include a memory 15.

The communication unit 12 is a communication module for transmitting and receiving a control message for performing a management command with the home appliance management server 2, data required for performing a management command, results of performing a management command, and the like. The communication unit 12 may include a wireless or wired communication module for performing communication with the home appliance management server 2. In particular, the wireless communication module is a module for communication with a device within a short range, which may be a module supporting short-range communication technique such as Bluetooth™, RFID (Radio Frequency Identification), IrDA (Infra-Red Data Association), UWB (Ultra Wideband), ZigBee™, Wireless LAN (protocols such as Bluetooth, 802.11n, etc.).

The input unit 11 and the output unit 14, passages connected to hardware constituting the home appliance 1 such as a household module, are user interfaces. The input unit 11 and the output unit 14 operate to transmit and receive a control signal according to a management command and state information. According to a control command or a management command input through the input unit 11, the home appliance 1 performs intrinsic functions thereof, e.g., a washing function, a cooking function, a cleaning function, a storage function, and the like. According to a command input through the input unit 11, the control unit 13 may control hardware constituting the home appliance 1 by using a previously stored application program, and display corresponding results through the output unit 14.

The memory 15 may store a program for an operation of the control unit 13, and temporarily store input/output data. Also, the memory 15 may store various software components. In detail, the memory 15 may store an operating system (OS), an application programs, a management platform, and the like. Also, the memory 15 may store software components including a module operating together with the communication unit 12, and a module operating together with the input unit 11 and the output unit 14.

The memory 15 may include at least one or more of types of storage medium such as a random access memory (RAM), a static random access memory (SRAM), a read-only memory (ROM), an electrically erasable programmable read-only memory (EEPROM), programmable read-only memory (PROM), a magnetic memory, a magnetic disk, an optical disk, a flash memory type, a hard disk type, a multimedia card micro type, a card type memory (e.g., an SD or XD memory, etc.). Also, the memory 15 may be in the form of a storage region according to a storage function provided by a network storage, a cloud service, or the like, connected through the communication unit 12.

An operating system (e.g., LINUX, UNIX, OS X, WINDOWS, Chrome, Symbian, WinCE, Windows Mobile, iOS, Android, Bada, VxWorks, pSOS, or any other embedded operating system) may include various software components and/or drivers for controlling system tasks such as a memory management, a power management, or the like. The operating system may be changed through a firmware updating process. The firmware updating process is performed according to a management command transmitted from the terminal device 3 to a DM client through DM server within the home appliance management server 2. The management command for firmware updating may be a command for requesting performing of an upgrade function.

An application program is a program executed in an operating system, including a program with respect to a unique function of the home appliance 1. In detail, the control unit 13 may execute the application program to control the home appliance (or the household module provided therein).

For example, when the home appliance is a washing machine equipped with hardware having a washing function, or the like, a state collecting signal and a control signal for managing components of the washing machine such as a washing drum control unit, a washing water supply unit, a sensor unit, a detergent adjusting unit, a vibration adjusting unit, or a level adjusting unit. In this case, the control signal, or the like, for managing the washing machine follows an application program indicating a washing method, or the like, according to a washing course of designating the method, order, time, and number of times of washing, rinsing, and spin-drying according to information formation regarding a washing subject such as quality of a material of clothes, fabric, or the like.

In another example, when the home appliance is a refrigerator equipped with hardware having a storage function, a state collecting signal and a control signal for managing components of the refrigerator such as a cooling unit, a temperature control unit, a sensor unit, or a power control unit are input through the input unit 11. Similarly, even in this case, the control signal, and the like, for managing the refrigerator follows an application indicating a storage method according to a storage mode, a maturing mode, or a keeping mode, and the like.

The application program may be changed through a software updating process. The software updating process may be performed according to a management command transmitted from the terminal device 3 to a DM client through a DM server, and the management command for software updating may be a command for requesting performing of an upgrade function.

A management platform is a management program executed in the operating system, which may be configured to include a DM client. The DM client transmits and receives a management message for managing a DM server within the home appliance management server 2 and the home appliance 1. Management functions performed by the DM client are management functions with respect to the household module mounted in the home appliance 1. For example, the management functions may include functions such as monitoring, diagnosis, upgrading, remote controlling, and the like.

The management platform may be configured to include a DM deamon. The DM deamon may receive a notification message transmitted through a notification server within the home appliance 1, for a DM client. Also, the DM deamon may perform a function of processing an exceptional matter of the DM client.

Also, the management platform may be configured to include a service agent. The service agent is used for the DM client to control the hardware within the home appliance according to a management command or execute a controller application program to control hardware.

The control unit 13 controls components constituting the home appliance. Namely, the control unit 13 controls the input unit 11, the communication unit 12, the output unit 14, the memory 15, hardware, and the like. The control unit 13 may be configured to execute software components stored in the memory 15. The control unit 13 may control the household module according to an application program. Also, the control unit 13 may execute or update an application program to perform a management command received from the home appliance management server 2.

Referring to FIG. 10, the home appliance management server 2 may be configured to include one or more of an application programming interface (API) server 21, a connection server 22, a download (DL) server 23, a DM server 24, and a notification server 25.

The API server 21 is an interface module providing a DM service to an application program or an external terminal of the home appliance management server 2. In detail, the API server 21 may be configured to include at least one of an interface function for authenticating whether or not an application program or a terminal that intends to access the DM service has been permitted, an interface function for remotely diagnosing the home appliance 1, an interface function for monitoring the home appliance 1, an interface function for controlling an application program of the home appliance 1, and an interface function for controlling the household module of the home appliance 1.

The connection server 22 may perform a message transfer function of transferring a management command request message transmitted from an external terminal to the home appliance 1 and transferring results of performing a management command according to a management command request message from the home appliance 1 to the home appliance management server 2.

The DL server 23 may perform a function of transmitting download data to the home appliance 1. The DL server 23 may be a module for transmitting the download data according to an OMA download standard.

The DM server 24 may perform a function of requesting performing of a management command and receiving management command performing results through transmission and reception of a control message with the DM client performing a function regarding a DM within the home appliance.

The notification server 25 may perform a notification function of transmitting and receiving a notification message for a device management to the home appliance 1. The notification server 250 may exchange a message in a push manner between the home appliance 1 and the DM server 24.

In FIG. 10, it is illustrated that the home appliance management server 2 is comprised of five servers which may be configured within a single device. In this case, the home appliance management server 2 may be configured to include a communication unit a storage unit, a controller, and the like.

The communication unit performs communication with the home appliance 1 and the terminal device 3.

The storage unit may store a program for an operation of the controller, or temporarily store input/output data. In particular, the storage unit may store modules for transferring a request for performing a management command received from the terminal device to the home appliance, and receiving results of performing the management command from the home appliance 1. In detail, the storage unit may be configured to include one or more of an API module, a connection module, a download module, a DM module, and a notification module.

The controller controls the components of the home appliance management server 2. Namely, the controller controls the communication unit and the storage unit. The controller may be configured to execute modules stored in the storage unit.

Hereinafter, an embodiment of the method for managing a home appliance of a home appliance management system will be described with reference to FIG. 11. FIG. 11 illustrates a method of transferring a management command to the home appliance 1 through the home appliance management server 2 by the terminal device 3, and receiving performing results.

The terminal device 3 transmits a management command request signal to the home appliance management server 2 according to a user input. Upon receiving the request signal, the home appliance management server 2 determines a type a management command included in the request signal, and determines a method for instructing a management command according to the determination results. The home appliance management server 2 instructs the home appliance 1 to perform the management command according to the determined instruction method. Also, when the management command performing results are required to be transmitted, the home appliance management server 2 transmits the same to the terminal device 3.

First, the home appliance management server 2 checks whether or not the terminal device 3 is a device eligible to request a management command with respect to the home appliance 1 (S10). In detail, the terminal device 3 transmits a log-in request message to the home appliance management server 2 (S11).

The log-in request message may include information for authenticating the terminal device 3 or an application program for a DM performed in the terminal device 3. The home appliance management server 2 may provide interface in the form of an application programming interface (API) formed for an application program executed in an external device to perform a management command with respect to the home appliance 1. In order to allow the permitted application program or device to call an interface, the home appliance management server 2 authenticates the application program, a device, or a user that calls the interface. The log-in request message may be an authentication message used to allow the home appliance 1 is eligible to use the interface.

The home appliance management server 2 checks the authentication information included in the log-in request message, and transmits check results with respect to the authentication information included in the log-in request message. When it is checked that terminal device 3 or an application program for a DM performed in the terminal device 3 is allowed to request a management command from the home appliance management server 2, the home appliance management server 2 transmits a log-in response message to the terminal device 3 (S12).

The log-in response message may include access information required for the terminal device 3 to request performing of the management command.

The access information may be access information of the management server 2 for receiving the request of the management command in real time. For example, the access information may be an IP address or a PCT port of the home appliance management server 2.

Next, the terminal device 3 may request a management command from the home appliance management server 2, and the home appliance management server 2 determines a type of the management command and requests the home appliance to perform initialization to perform a management process according to determination results with respect to the type of the management command (S20). Of course, the home appliance management server 2 may be configured to process regardless of the type of the management command.

In detail, the terminal device 3 may access the home appliance management server 2 to request the home appliance management server 2 to perform the management command (S21). Thereafter, the home appliance management server 2 determines a type of the requested management command (S22).

The type of the management command may be identified according to a method for transmitting and receiving a control message for performing the management command between the home appliance management server 2 and the home appliance 1. For example, a first form of the management command may indicate a method in which a request for performing the management command and a transmission of performing results are made by transmitting and receiving a control message following an OAM DM standard. In case of the transmission and reception method following the OMA DM standard, connections between the home appliance management server 2 and the home appliance 1 are established and released repeatedly to transmit and receive a plurality of messages for the management command, so the first form may correspond to a management command indicating non-real time characters in performing the management command.

A second form of the management command indicates a relay method through a connection-oriented session, namely, a method in which a request for performing the management command and a transmission of performing results are made by transmitting and receiving a plurality of data packets through a connection continuously maintained between the home appliance management server 2 and the home appliance. The second form may correspond to a management command indicating a real-time character.

Whether or not the management command has the real time characters may be determined based on whether or not the management command should be performed within a predetermined time after the home appliance management server 2 or the home appliance 1 receives the management command. Also, the home appliance management server 2 may determine a type of the management command based on the form of the API used to request performing of the management command. In another example, the home appliance management server 2 may determine a type of the management command based on the characteristics of a connection between the home appliance management server and the terminal device 3 established to request the management command.

Thereafter, the home appliance management server 2 performs an initial process to transfer the management command to the home appliance 1 according to the determination results with respect to the type of the management command (S23).

Thereafter, the home appliance management server 2 requests the home appliance 1 to perform the management command, and transmits and receives a control message for receiving performing results, thus performing a management process (S30). The method for transmitting and receiving the control message for the DM in the management process S30 may be different according to a type of the management command.

Thereafter, the home appliance management server 2 transmits the performing results of the management process to the terminal device 3 as necessary (S40).

Referring to FIG. 1, a power control system according to an embodiment of the present invention is configured to include a power source breaker 30, an input current detection unit 40, and a home appliance driven upon receiving input power from the input power source 20. The power source breaker 30 is installed in a power line of the input power source 20, and when the input current from the input power source is an overcurrent, the power source breaker 30 breaks the power line. The input current detection unit 40 detects the input current and transmits input current information by using a wired/wireless communication method. The home appliance includes the cooker 10 having one or more burners and controlling driving power with respect to the one or more burners such that the input current cannot become an overcurrent based on the input current information.

Referring to FIG. 2, a power control system according to another embodiment of the present invention is configured to include a power detection unit 50 connected to the home appliance and the input power source 20, detecting an input current from the input power source and transmitting input current information to the home appliance, and measuring power consumption of the home appliance, and the cooker 10 having one or more burners and controlling driving power with respect to the one or more burners such that the input current cannot become an overcurrent based on the input current information.

The power detection unit 50 may include a power source breaker installed in a power line of the input power source and breaking the power line when the input current is an overcurrent. The power detection unit 50 is a watt-hour meter for measuring power consumption of the home appliance including the cooker 10. The watt-hour meter is a smart meter receiving power information from the input power source or from a generation facility at the front stage of the input power source. The power detection unit 50 transmits the input current information to the cooker and a home appliance including a communication unit. Also, the power detection unit 50 may transmit power information to the cooker and the home appliance. In this case, the power detection unit 50, the cooker, and the home appliance may transmit and receive information by using a wired communication scheme including power line communication or a wireless communication scheme including Wi-Fi, RF communication, and the like.

Referring to FIG. 4, in the power control system according to embodiments of the present invention, the power line of the input power source may be branched into two or more load power lines. Also, home appliances may be installed in the branched load power lines. Here, the power control system may be configured to further include a plurality overcurrent breakers 60 installed in the respective load power lines. When respective load currents flowing along the load power lines are equal to or greater than a predetermined reference current, the plurality of overcurrent breakers 60 may break the load power lines.

Also, referring to FIG. 3, when a plurality of home appliances are installed in one of the branched power source lines, for example, when the cooker shares one branched power line with other home appliances, a load current detection unit 70 may be installed. The load current detection unit 70 is installed between the overcurrent breaker 60 and the home appliance 1, detects the load current and transmits load current information regarding the load current to the home appliance 1.

The respective home appliances constituting the power control system add up power consumption of the home appliances sharing the input power and perform power control to reduce power consumption within a range in which the power source breaker 30 installed in the power line of the input power source is not opened. For example, the cooker adds up power consumption of other home appliances and power consumption of the cooker. The cooker controls driving power for driving a burner (or burners) such that the sum of power consumption is equal to or lower than pre-set reference power consumption. Here, the reference power consumption is set which current will not to exceed a limit current, e.g., 30A, of the power source breaker.

Hereinafter, a method for controlling power in the power control system configured as described above will be described based on the cooker among home appliances with reference to FIGS. 5 through 8.

Referring to FIG. 5, the cooker according to an embodiment of the present invention is configured to include one or more burners 100 having an induction heating coil and a resonant capacitor and heating a container, a power supply unit 200 converting input power from the input power source into driving power and supplying the driving power to the one or more burners 100 according to a control signal, and a control unit 300 for generating the control signal based on input current information regarding the input current from the input power source, and outputting the control signal to the power supply unit to control the driving power with respect to the one or more burners. Also, the cooker may be configured to further include the communication unit 400 for receiving the input current information.

Referring to FIG. 6, the power supply unit 200 may be configured to include a converter 210 for converting an input voltage of the input power source into a DC voltage, a smoothing unit 220 for smoothing an output DC voltage from the converter 210, and an inverter for converting the output DC voltage from the smoothing unit 220 into a driving voltage of the driving power.

The converter 210 is a conversion unit connected to the input power source 20, e.g., a commercial AC power source and converting an AC voltage input from the input power source into a DC voltage. As the converter 210, a power bridge diode (PBD) is generally used. Here, the DC voltage generally has a waveform of a ripple current. A power factor improvement converter may be used as necessary.

The smoothing unit 220 smoothes the DC voltage having the waveform of a ripple current output from the converter 210, through a smoothing capacitor C1. A voltage applied to the smoothing capacitor C1 in this case is called a DC link voltage. The smoothing unit 220 may further include a reactor L1 for removing harmonics generated according to switching of the converter 210.

The inverter 230 includes a switching element of a high frequency semiconductor. The switching element of a high frequency semiconductor may be formed as one of high frequency elements such as a bipolar junction transistor (BJT), a metal oxide semiconductor field effect transistor (MOSFET), an insulated gate bipolar transistor (IGBT), and the like. Here, the insulated gate bipolar transistor (IGBT) is a junction type transistor in which a metal oxide film semiconductor field effect transistor is included in a gate unit. The IGBT is a semiconductor element that is able to perform high speed switching at high power. Also, the inverter 230 may further include a backward diode connected in parallel to the high frequency semiconductor switching element. The control unit 300 outputs a control signal for driving the switching element of the inverter 230, and here, the control signal is a pulse width modulation (PWM) signal as a gate input signal.

Referring to FIG. 6, the burner 100 includes an induction heating coil L2 and a resonant capacitor C2 and heats a container by using a resonance phenomenon. The control unit 300 generally heats the burner 100 by adjusting a frequency. For example, the control unit 300 may generate a control signal according to a resonance frequency by the induction heating coil L2 and the resonance capacitor C2, and output the generated control signal to the inverter 230.

For example, when a single burner 100 is provided, the control unit 300 controls the driving power by changing a frequency of the control signal. When two or more burners 100 are provided, the control unit 300 distributes the driving power to the burners 100. For example, the control unit 300 may set priority of the respective burners, and reduces the driving power of the burners by changing a frequency of the control signal in order starting a burner having the lowest priority. For example, the burner which was finally installed may be given high priority and driving power of the other burners may be first adjusted downwardly (reduced). Also, priority may be set according to a burner capacity. In another example, the control unit 300 may accumulate driving time of the burners, and reduce driving power starting from a burner having the smallest accumulation time.

The cooker 10 may further include a circuit breaker (not shown) for breaking the power line of the input power source when the input current is equal to or greater than a predetermined reference current. Here, a reference current may be 20A, 30A, or the like. Here, the cooker 10 is connected alone with the input power source. In another example, referring to FIG. 1, the power source breaker 30 installed in the power line of the input power source 20 and the overcurrent breaker 60 installed in the power source line provided to the cooker may be discriminated from one another. In this case, the circuit breaker included in the cooker is an overcurrent breaker.

As illustrated in FIG. 3, when the cooker shares one branched power line with other home appliances, the cooker may include a separate current detection unit (not shown). Namely, the cooker may further include a current detection unit connected to the communication unit according to a wired/wireless communication scheme, detecting the input current, generating the input current information, and transmitting the generated input current information to the communication unit. Referring to FIG. 3, the cooker may include a load current detection unit. 70.

Also, the cooker may further include an output unit (not shown) displaying input current information from an input current detection unit, a power detection unit, a current detection unit (not shown) on a screen. The output unit may be configured as a light emitting diode (LED), a liquid crystal display (LCD), or the like.

Referring to FIGS. 7 and 8, a method for controlling power of a cooker including one or more burners having an induction heating coil and a resonant capacitor and heating a container according to an embodiment of the present invention includes a step (S100) of detecting an input current of an input power source, a step (S200) of comparing the input current with a predetermined reference current, and a step (S300) of controlling driving power with respect to the one or more burners when the input current is lower than the reference current. Also, the power control method may further include a step (S400) of breaking a power line of the input power source when the input current is equal to or greater than the predetermined reference current. Elements of the device hereinafter will be referred to FIGS. 1 to 6.

Respective home appliances constituting a power control system add power consumption of home appliances sharing the input power source and perform power control in order to reduce power consumption within a range in which a power source breaker installed in a power line of the input power source is not opened. For example, the cooker adds up power consumption of different home appliance(s) and power consumption of the cooker. The cooker controls driving power for driving a burner (or burners) such that the sum of power consumption is equal to or lower than pre-set reference power consumption set not to exceed a limit current, e.g., 30A, of the power source breaker.

When the cooker shares the input power source with other home appliances, the power control method may further include a step (S332) of calculating power consumption of each of the other home appliances sharing the input power source. Here, the step (S300) of controlling driving power may include a step (S333) of setting predetermined reference power consumption under a condition in which the input current is maintained to be lower than the reference current, a step (S334) of comparing the sum of the power consumption and the driving power with the reference power consumption, and a step (S335) of reducing the driving power when the sum of the power consumption is equal to or greater than the reference power consumption.

Referring back to FIG. 7, the method for controlling power of the cooker includes a step (S1) of converting an input voltage of the input power source into a DC voltage, a step (S2) of smoothing the converted DC voltage, and a step (S3) of converting the smoothed DC voltage into a driving voltage of the driving power. The cooker converts an input voltage of the input power source, e.g., a commercial AC power, into a DC voltage through a converter (S1). Harmonics of the converted voltage are removed through a smoothing unit and the converted voltage is smoothed (S2). The converted voltage is charged as a DC link voltage in a smoothing capacitor. A current of high frequency flows from the smoothing capacitor to the burner according to ON/OFF driving of the switching element of the inverter that drives the burner.

Referring to FIG. 8, when one burner is provided, the cooker controls the driving power by changing a frequency of the control signal (S312). For example, the cooker changes a frequency of the control signal into a frequency, rather than a resonant frequency (S312) to reduce a driving current to thus reduce driving power (S313). When two or more burners are provided, the cooker distributes driving power with respect to the burners. For example, the cooker sets priority of the burners (S321), and reduces driving power by changing a frequency of the control signal in order starting from the burner having the lowest priority (S322, S323). For example, the cooker may give priority to the finally installed burner and first reduces driving power of the other burners. Also, priority may be set according to burner capacity. In another example, the cooker may accumulate driving time of the burners and reduce driving power starting from a burner having the smallest accumulation time.

As described above, in the case of the cooker, a method for controlling power of a cooker, and a power control system including the same, a high power cooking device can be used without making an additional power construction work or causing a power circuit breaker installed in an input terminal of a household power source to be opened.

According to embodiments of the present invention, since driving power of a burner is controlled or distributed by using a current flowing in a power circuit breaker or an overcurrent breaker installed in a load end, power operation efficiency of an input power source can be enhanced and the input power source is not broken.

The invention claimed is:

1. A cooker comprising:

one or more burners having an induction heating coil and a resonant capacitor, and configured to heat a container;

a power supply unit configured to convert input power of an input power source into driving power and configured to supply the driving power to the one or more burners according to a control signal; and a control unit configured to generate the control signal based on input current information regarding an input current of the input power source, and output the control signal to the power supply unit to control the driving power with respect to the one or more burners, wherein the input power source is shared with a plurality of other home appliances, and wherein the cooker is configured to calculate power consumption of the plurality of other home appliances.

2. The cooker of claim 1, further comprising:

a communication unit configured to receive the input current information.

3. The cooker of claim 2, wherein when a single burner is provided, the control unit controls the driving power by changing a frequency of the control signal.

4. The cooker of claim 2, wherein when two or more burners are provided, the control unit distributes the driving power to the burners.

5. The cooker of claim 4, wherein when two or more burners are provided, the control unit sets priority of the burners, and reduces the driving power by changing the frequency of the control signal in an order starting from the lowest priority.

6. The cooker of claim 1, wherein the power supply unit comprises:

a converter configured to convert an input voltage from the input power source;

a smoothing unit configured to smooth an output DC voltage; and an inverter configured to convert the output DC voltage from the smoothing unit into a driving voltage of the driving power.

7. The cooker of claim 6, further comprising:

a circuit breaker configured to break a power line of the input power source when the input current is equal to or greater than a predetermined reference current.

8. The cooker of claim 7, further comprising:

a current detection unit connected to the communication unit according to a wired/wireless communication scheme and configured to detect the input current, generate the input current information, and transmit the generated input current information to the communication unit.

9. A power control system comprising:

a power circuit breaker installed in a power line of an input power source, and configured to break the power line when an input current from the input power source is an overcurrent;

an input current detection unit configured to detect the input current and transmit input current information by using a wired/wireless communication scheme; and a home appliance driven upon receiving input power from the input power source, wherein the home appliance includes a cooker having one or more burners and controlling driving power with respect to the one or more burners based on the input current information such that the input current cannot be an overcurrent, wherein the input power source is shared with a plurality of other home appliances, and wherein the cooker is configured to calculate power consumption of the plurality of other home appliances and a control unit is configured to control the driving power based on the input current information.

10. A power control system comprising:

a home appliance driven upon receiving power from an input power source; and a power detection unit connected to the input power source, detecting an input current from the input power source and transmitting input current information to the home appliance, and measuring consumed power of the home appliance, wherein the home appliance includes a cooker having one or more burners and controlling driving power with respect to the one or more burners based on the input current information, wherein the input power source is shared with a plurality of other home appliances, and wherein the cooker is configured to calculate power consumption of the plurality of other home appliances and a control unit is configured to control the driving power based on the input current information.

11. The power control system of claim 10, wherein the power detection unit comprises a power circuit breaker installed in a power line of the input power source, and breaks the power line when the input current is an overcurrent.

12. The power control system of claim 10, wherein the power line of the input power source is branched into two or more load power lines, and further comprising:

a plurality of overcurrent breakers installed in respective load power lines, and breaking the load power lines when respective load currents flowing along the load power lines are equal to or greater than a predetermined reference current.

13. The power control system of claim 12, further comprising:

a load current detection unit installed between the overcurrent breaker and the home appliance, configured to detect the load current, and transmit load current information regarding the load current to the home appliance.

14. A method for controlling power of a cooker including one or more burners having an induction heating coil and a resonant capacitor and heating a container, the method comprising:

detecting an input current from an input power source;

comparing the input current with a predetermined reference current; and when the input current is less than the reference current, controlling driving power with respect to the one or more burners, wherein the method further comprising:

calculating power consumption of other home appliances sharing the input power, wherein the controlling of the driving power comprises:

setting predetermined reference power consumption under a condition that the input current is maintained below the reference current;

comparing the sum of the power consumption and the driving power with the reference power consumption; and when the sum of the power consumption and the driving power is equal to or greater than the reference power consumption, reducing the driving power.

15. The method of claim 14, wherein, in the controlling of the driving power, when a single burner is provided, the driving power is controlled by changing a frequency of the control signal for driving the burner.

16. The method of claim 14, wherein the controlling of the driving power comprises:

when two or more burners are provided, setting priority of the burners; and reducing the driving power by changing the frequency of the control signal for driving the burners in an order starting from the lowest priority.

17. The method of claim 14, further comprising:

converting input a voltage of the input power source into a DC voltage;

smoothing the converted DC voltage; and converting the smoothed DC voltage into a driving voltage of the driving power.

18. The method of claim 14, further comprising:

when the input current is equal to or greater than a predetermined reference current, breaking a power line of the input power.

* * * * *